US005111955A

United States Patent [19]

Baker et al.

[11] Patent Number: 5,111,955

[45] Date of Patent: May 12, 1992

[54] NON-METALLIC ACID HATCH

[75] Inventors: Robert L. Baker; Larry D. Billingsley; Calvin L. Stegemoeller, all of Duncan, Okla.

[73] Assignee: Halliburton Company, Duncan, Okla.

[21] Appl. No.: 568,912

[22] Filed: Aug. 16, 1990

[51] Int. Cl.[5] ..... B65D 51/16

[52] U.S. Cl. ..... 220/303; 220/203; 220/204; 220/254; 220/288; 220/304; 220/327; 220/366; 220/367; 220/368

[58] Field of Search ..... 220/288, 203, 204, 303, 220/304, 366, 367, 368, 375, 85 S, 89.1, 562, 601, 661, DIG. 24, 327, 254, 324

[56] References Cited

U.S. PATENT DOCUMENTS

| | | | |
|---|---|---|---|
| 1,212,878 | 1/1917 | Augenbraun | 220/324 X |
| 1,579,224 | 4/1926 | McBride | 220/327 X |
| 2,274,319 | 2/1942 | Chesterman | 220/327 X |
| 2,843,290 | 7/1958 | Hooper | 220/203 |
| 3,380,618 | 4/1968 | Phillips | 220/288 |
| 3,393,824 | 7/1968 | Appleton | 220/288 |
| 3,470,927 | 10/1969 | Craig | 220/304 |
| 4,005,797 | 2/1977 | Mannaerts | 220/288 |
| 4,195,750 | 4/1980 | Fee | 220/288 |
| 4,245,754 | 1/1981 | Ellis | 220/304 |
| 4,252,249 | 2/1981 | Beckhardt et al. | 220/284 |
| 4,512,499 | 4/1985 | Uuskallio | 220/374 |
| 4,526,289 | 7/1985 | Schiemann | 220/304 |
| 4,576,308 | 3/1986 | Sullivan | 220/327 |
| 4,779,754 | 10/1988 | Ten Eyck et al. | 220/254 |
| 4,898,296 | 2/1990 | Burgdorf et al. | 220/288 X |
| 5,004,114 | 4/1991 | Terbrusch et al. | 220/296 |
| 5,033,639 | 7/1991 | Przytulla | 220/604 |

FOREIGN PATENT DOCUMENTS

| | | | |
|---|---|---|---|
| 97691 | 3/1964 | Denmark | 220/DIG. 24 |

OTHER PUBLICATIONS

Exhibit D—Brochure of Poly Processing Company entitled "Transtore Tanks Series II" dated Jun. 1, 1988.

Exhibit F—Brochure of Bonar Plastics entitled "Bonar Plastics Poly Payloader" dated Mar. 1988.

*Primary Examiner*—Stephen Marcus

*Assistant Examiner*—Stephen Cronin

*Attorney, Agent, or Firm*—James R. Duzan; L. Waune Beavers

[57] ABSTRACT

A non-corrosive, non-metallic hatch apparatus is provided for use on a container having a container opening with a container flange surrounding the container opening. A hatch base includes a base flange complementary to and constructed to be bolted to the container flange. The hatch base has a hatch opening defined therethrough and includes a base thread surrounding the hatch opening. A non-metallic hatch lid includes a lid thread defined thereon which is complementary to the base thread so that the hatch lid can be attached to the hatch base to close the hatch opening by threaded engagement of the lid thread with the base thread.

29 Claims, 3 Drawing Sheets

NON-METALLIC ACID HATCH

BACKGROUND OF THE INVENTION

1. Field of the Invention

The present invention relates generally to closure devices for containers, and more particularly, but not by way of limitation, to a manway hatch suitable for use in corrosive service.

2. Description of the Prior Art

A number of oilfield related services involve the use of corrosive fluids such as acid which must be transported to the well site in substantial volumes. The potentially hazardous nature of these fluids requires that great care be taken when transporting them over the public highways. Numerous regulations are in effect regarding the transport of such materials.

Typically, corrosive fluids for use in the servicing of oil wells are transported in metal tanks carried on the back of a truck or trailer. These tanks have manways therein with bolted flanges surrounding the manways. The manways are typically closed through the use of a metal manway cover such as that known as the Clay & Bailey Model 1890. The Clay & Bailey manway includes a base portion having a bolted flange adapted to be bolted to the flange surrounding the manway of the acid tank. A metal cover is connected by a hinge to the base portion. A plurality of cam locking arms fold over the metal cover when it is in a closed position to lock the same in place. The Clay & Bailey manway cover may have the inner surface thereof lined when used for corrosive service. Nevertheless, such a manway cover includes a number of intricately shaped metal components such as cams, latches, pins and the like which are subject to external corrosion.

The prior art also includes non-metallic containers for corrosive fluids. One example of such containers includes those sold by Poly Processing Company of Monroe, La., sold under the designation Transtore Tanks Series II. The Poly Processing Company tanks are manufactured from high density polyethylene and have integrally molded therewith access openings having a female thread within which is threadedly received a male threaded cover plug having hammer lugs molded on its external surface.

Another prior art non-metallic tank is that sold by Bonar Plastics under the designation Poly Payloader ®. These containers have an integrally molded neck with external male threads defined thereon. A molded non-metallic cap screws onto the threaded neck to close the access opening.

SUMMARY OF THE INVENTION

The present invention provides an improved hatch apparatus for use on containers for corrosive materials. The hatch apparatus can be retrofitted on containers having manway openings with bolted flanges surrounding the openings, like those with which the Clay & Bailey Model 1890 manways described above have previously been used. The improved manway is completely non-metallic in construction thus providing a non-corrosive hatch assembly.

The hatch apparatus is adapted for use with a container having a container or manway opening defined therein with a bolted container flange surrounding the container opening.

The hatch apparatus includes a non-metallic hatch base which includes a cylindrical collar portion having a hatch opening defined therethrough and having an axially inner end and an axially outer end. A base flange is integrally formed with the collar portion and extends radially outward from the inner end thereof. The base flange has a pattern of bolt holes defined therein so that it may be bolted to the container flange. An annular upward extending lip is integrally formed on an outer edge of the base flange so that the lip, base flange and collar portion define an upwardly open annular spill-well surrounding the collar portion. An external male base thread is defined on the collar portion adjacent the axially outer upper end thereof.

The hatch apparatus further includes a non-metallic hatch lid which has a disc-shaped cover portion. An annular skirt is integrally formed with and extends downward from the cover portion and has a female lid thread defined therein so that the lid thread can be threadedly engaged with the base thread to close the hatch opening. A handle is integrally formed on an upper surface of the cover portion. A plurality of hammer lugs are integrally formed with the cover portion.

The hatch apparatus also includes an annular seal disposed between the hatch base and the hatch lid for sealing between the hatch base and the hatch lid around the hatch opening.

Numerous objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1:
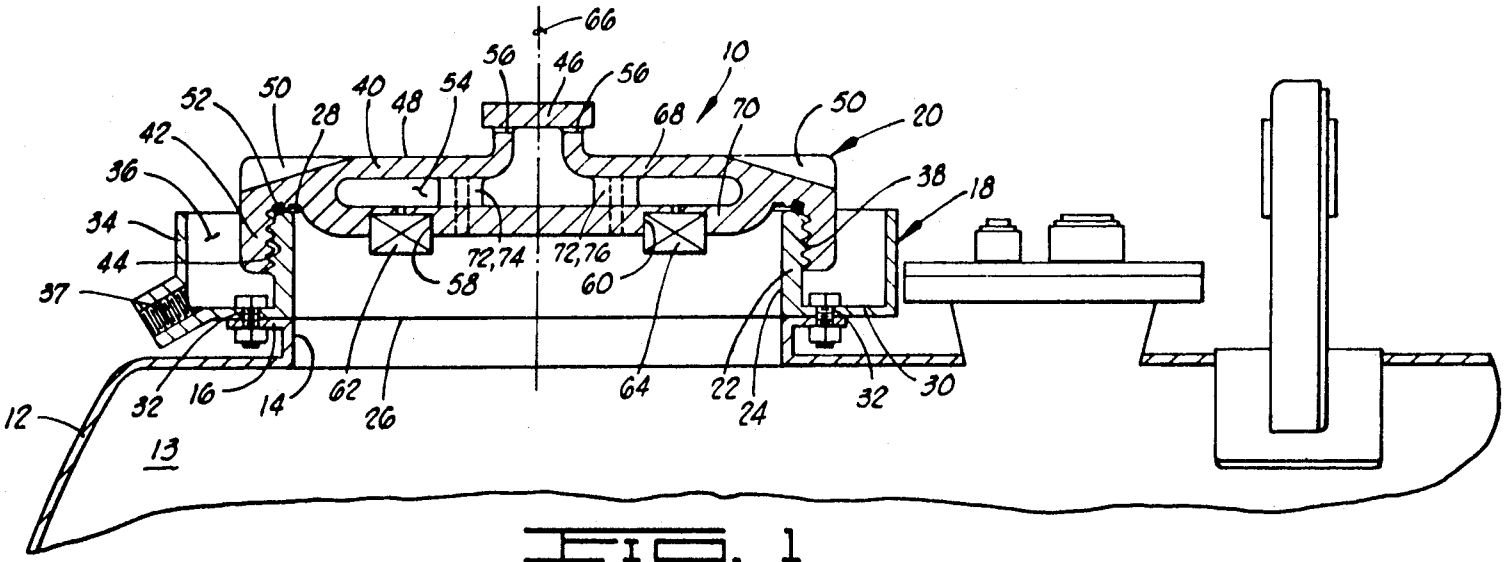
FIG. 1 is an elevation sectioned view of a first embodiment of the hatch apparatus of the present invention assembled with a container.

Referring now to the drawings, and particularly to FIG. 1, a hatch apparatus generally designated by the numeral 10 is shown in place on a container 12 having a container opening or manway 14 defined therein with a bolted container flange 16 surrounding the container opening 14. Container 12 has an interior 13.

The hatch apparatus 10 generay includes a non-metallic hatch base 18 and a non-metallic hatch lid 20. The hatch base 18 and hatch lid 20 are preferably molded from a cross-linked polyethylene material in a roto-molding process.

The hatch base 18 includes a cylindrical collar portion 22 having a hatch opening 24 defined therethrough and having a lower or axially inner end 26 and an upper or axially outer end 28.

The hatch base 20 further includes a base flange 30 integrally formed with the collar portion 22 and extending radially outward from the inner end 26 thereof. The base flange 30 has a pattern of bolt holes 32 defined therein corresponding to the pattern of holes in container flange 16 so that the two may be bolted together. A flange gasket (not shown) may be located between the container flange 16 and base flange 30.

The hatch base 18 further includes an angular upward extending lip 34 integrally formed on a radially outer portion of the base flange 30 so that the lip 34, base flange 30 and collar portion 22 define an upwardly open annular spillwell 36 surrounding the collar portion 22.

The hatch base 18 includes a drain means 37 for draining the spillwell 36. The drain means 37 is shown as an internally threaded conduit communicated with the spillwell 36. Drain means 37 may be utilized in a number of ways. First, it may be closed by a removable plug. Second, a drain valve may be attached thereto. Third, a suitable conduit can be connected to the drain means 37 and lead away to a receptacle for the drained fluids. It will be appreciated that during the filling of container 12, any liquid spilled adjacent the collar portion 22 will be caught in spillwell 36 and can be drained therefrom by drain means 37.

The hatch base 18 further includes an external male base thread 38 defined on the collar portion 22 adjacent the outer end 28 thereof.

The hatch lid 20 includes a disc-shaped cover portion 40, with an annular skirt 42 integrally formed with and extending downward from the cover portion 40 and having a female lid thread 44 defined therein, so that the lid thread 44 can be threadedly engaged with the base thread 38 to close the hatch opening 24.

The hatch lid 20 further includes a handle 46 integrally formed on the upper surface 48 of cover portion 40 in an axially central location thereon. Hatch lid 20 further includes a plurality of hammer lugs 50 integrally formed on the cover portion 40.

Hatch apparatus 10 further includes an annular seal means 52 disposed between the hatch base 18 and hatch lid 20 for sealing around the hatch opening 24. The seal means 52 is disposed inside of the lid thread 44 so that liquid in the container 12 is prevented from reaching the threads 44 and 38. Seal means 52 preferably is an O-ring disposed in a groove defined in the underside of lid 20.

Figure 5:
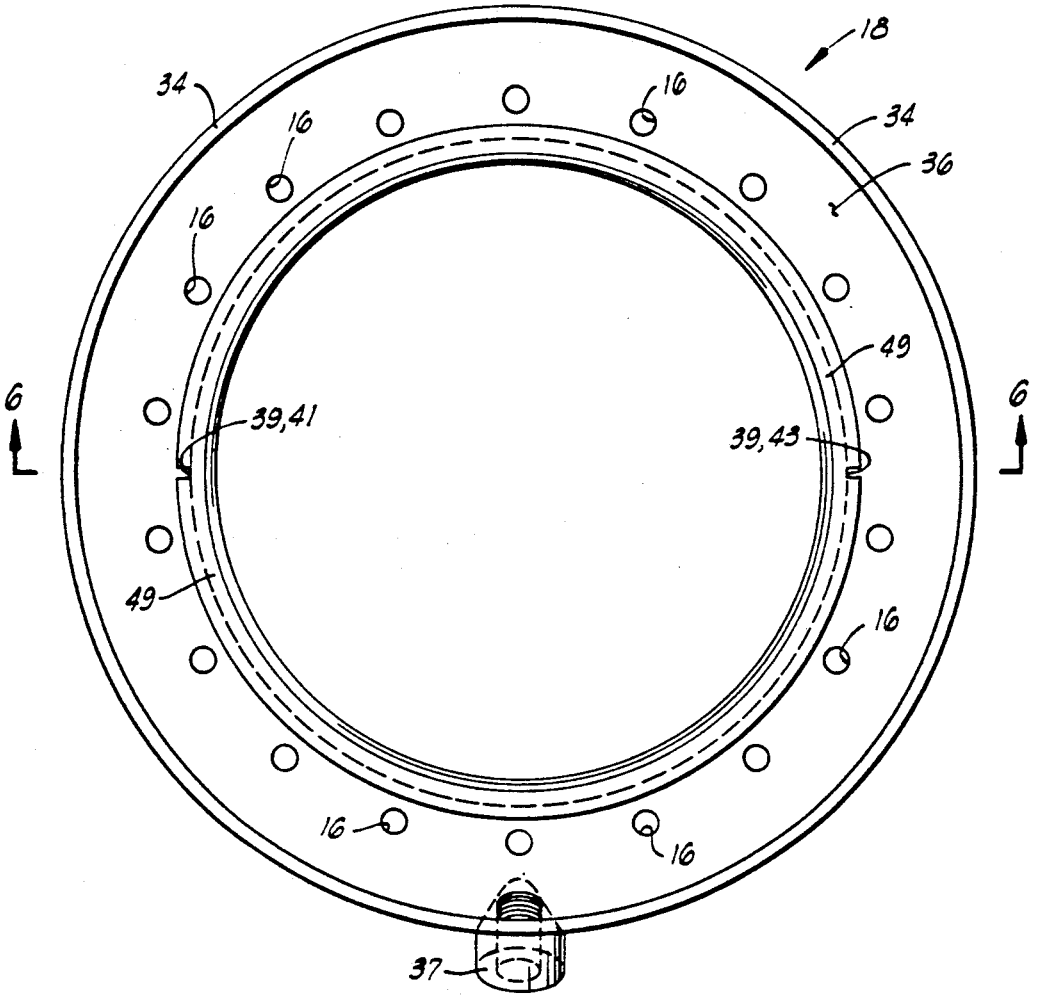
FIG. 5 is a plan view of the hatch base of the apparatus of FIGS. 1 and 2, in which view a safety vent groove is visible.
Figure 6:
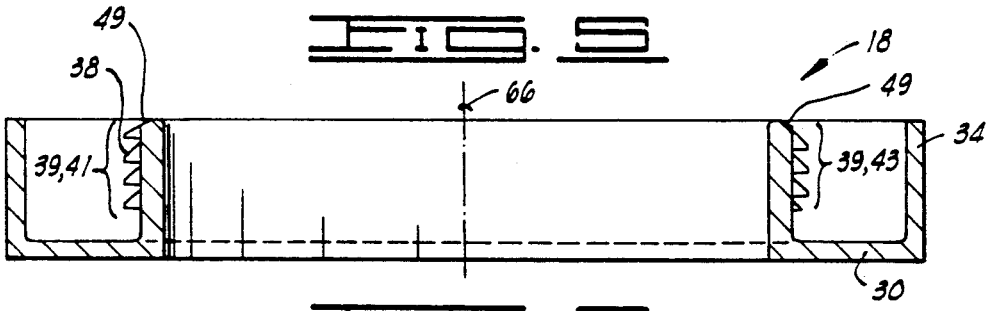
FIG. 6 is a sectioned view taken along lines 6—6 of FIG. 5 and further illustrating the safety vent groove.

Referring now to FIG. 5, a plan view is thereshown of the hatch base 18. FIG. 6 shows an elevation sectioned view of the hatch base 18 taken along line 6—6 of FIG. 5.

The apparatus 10 has defined therein a safety vent means 39 for releasing pressure in the container 12 as soon as the annular seal means 52 is broken when the hatch lid 20 is being threadedly removed from the hatch base 18. This safety vent means 39 includes at least one vent groove defined in one of the said base thread 38 and the said lid thread 44. Preferably, two safety vent grooves 41 and 43 are defined across the male base thread 38 generally parallel to a central axis 66 of the hatch opening 24.

Figure 7:
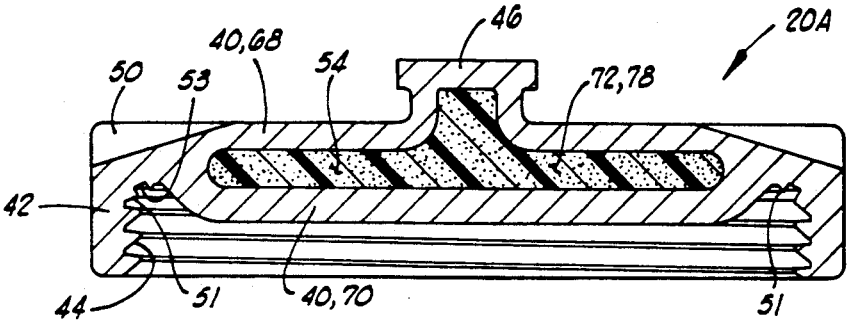
FIG. 7 is an elevation sectioned view of another alternative embodiment of the hatch lid having an injected rigid foam support means between the inner and outer walls of the lid.

The outer end of the hatch base 18 has a tapered conical sealing surface 49 defined thereon, as best seen in FIG. 6. The hatch lid 18 has a conical lid surface 51 defined on the underside thereof, as best seen in FIG. 7, which is complementary to the conical sealing surface 49 of hatch base 18. The lid surface 51 has a groove 53 defined therein with the groove 53 facing the conical sealing surface 49. The seal means 52 includes an O-ring seal 55 disposed in the groove 53 and sealingly engaging the tapered conical sealing surface 49.

With this sealing arrangement, when the threads 38 and 44 are tightly engaged, there is a wedging action between the conically tapered sealing surface 49 and the complementary conical lid surface 51 which tends to wedge the upper end 28 of collar 22 against the conical lid surface 51 thus providing a tight sealing arrangement between O-ring 55 and conical sealing surface 49.

To remove the hatch lid 20 from a hatch base 18 when the apparatus 10 is in place in service upon a container 12, the hatch lid 20 is rotated to begin to disengage the threads 38 and 44. When those threads are disengaged sufficiently that the seal of the O-ring 55 against the tapered conical sealing surface 49 is broken, any pressure differential between the interior 13 of container 12 and the surrounding atmosphere is immediately vented through the safety vent grooves 41 and 43.

The hatch lid 20 is a hollow hatch lid 20 defining an interior lid chamber or cavity 54 therein. The lid 20 includes a plurality of vents 56 communicating the chamber 54 with the earth's atmosphere. The hatch lid 20 further includes first and second threaded ports 58 and 60 communicating the chamber 54 with the interior 13 of container 12.

First and second pressure relief means 62 and 64 are schematically illustrated as being disposed in the first and second ports 58 and 60 for relieving a pressure differential between the interior 13 of container 12 and the atmosphere surrounding the container 12. For example, the first pressure relief means may be a pressure relief valve for relieving excess pressure within tank 12 to the outside atmosphere. The second pressure relief means 64 may be a vacuum relief valve for allowing air from the atmosphere to flow into the tank 12 if an excess vacuum condition is drawn within the tank 12.

It will be understood that depending on the nature of usage of the container 12, either or both of the pressure relief means 62 and 64 may be utilized. In cases where neither pressure relief means is utilized, the ports 58 and 60 will be closed with threaded plugs.

Also, if desired, one or both of the ports 58 and 60 can be left open to provide an open vent for the container 12.

It is noted that the chamber 54 extends upward into the centrally located handle 46, and that the vents 56 are defined laterally through a side wall of the handle 46 in directions generally radial from a longitudinal axis 66 of the hatch opening 24

The cover portion 40 of hatch lid 20 includes an axially outer wall 68 and an axially inner wall 70 which define the cavity or chamber 54 therebetween.

Hatch lid 20 further includes a support means 72 disposed in the cavity 54 and extending between the axially outer wall 68 and the axially inner wall 70 for structurally interconnecting and rigidifying said axially outer wall 68 and said axially inner wall 70.

In FIG. 1, the support means 72 includes a plurality of support pillars such as 74 and 76 integrally molded with the axially outer wall and axially inner wall 68 and 70.

FIG. 7 shows an elevation sectioned view of an alternative embodiment of the hatch lid, designated as 20A, having a different type of support means 72. In the embodiment of FIG. 7, the support means 72 is comprised of a rigid polyurethane foam filling 78 which has been injected into the chamber 54. There are no integral support pillars such as 74 and 76. The foam filling 78 can generally be described as a rigid polymeric foam substantially completely filling the cavity 54. The foam 78 is injected into the cavity 54 through one or more injection holes (not shown).

It is noted that in the embodiment of FIG. 7, wherein the cavity 54 is filled with the rigid foam material 78, there is no provision for vents 56 or pressure relief means 62 or 64.

Figure 2:
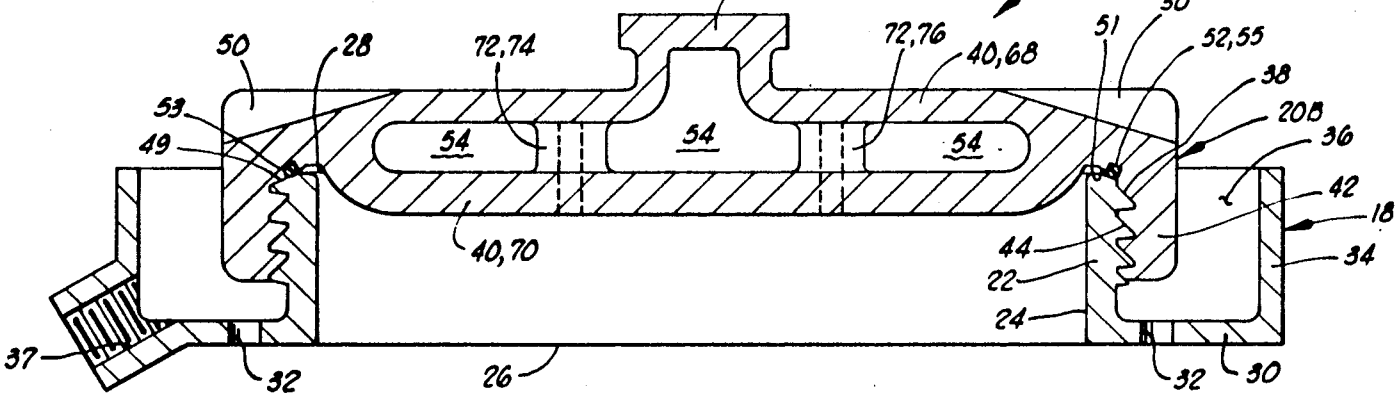
FIG. 2 is an elevation sectioned view of an alternative embodiment of the hatch apparatus of the present invention.

FIG. 2 illustrates another slightly modified version of the hatch lid which has been designated as 20B. The hatch lid 20B is constructed generally similar to the hatch lid 20 of FIG. 1, except that the threaded openings 58 and 60, the pressure relief means 62 and 64, and the vents 56 have been deleted, so that the hatch lid 20B does not have any provision for venting between the container interior 13 and the atmosphere so long as the hatch lid 20B is tightly secured to the hatch base 18.

Figure 3:
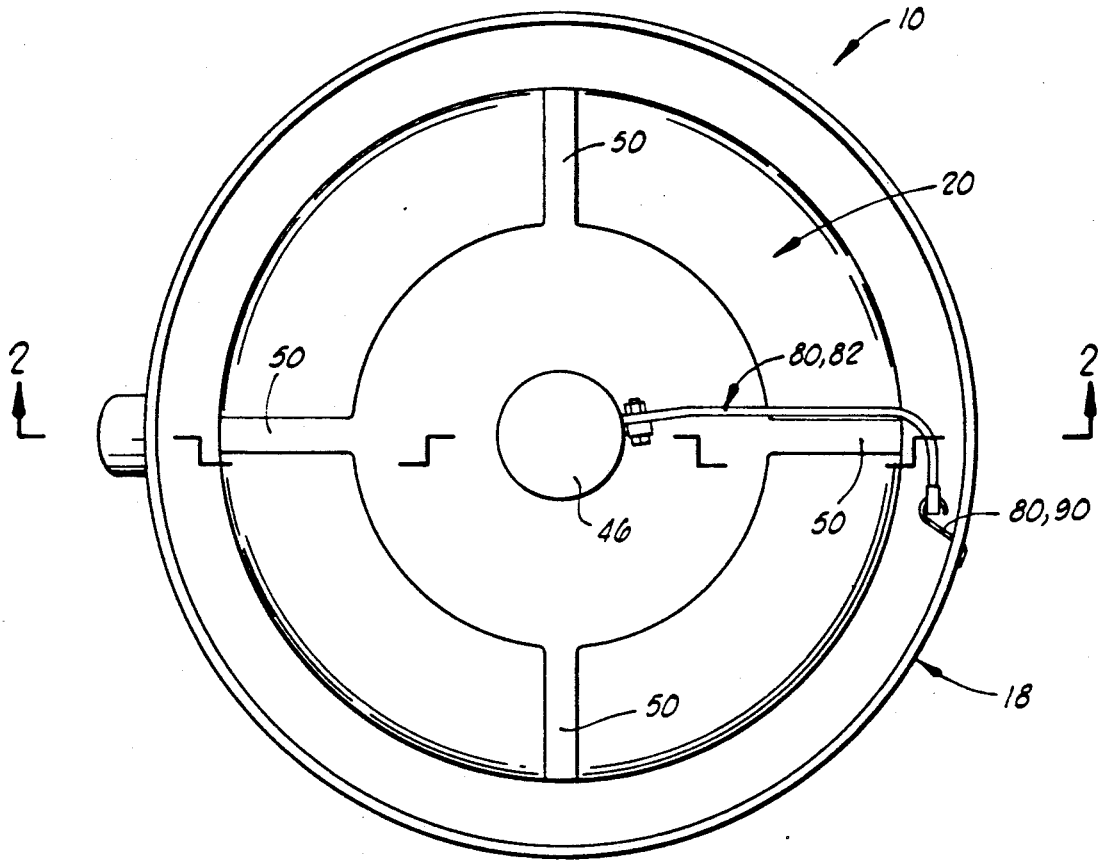
FIG. 3 is a plan view of the apparatus of FIG. 2, showing a retainer strap in place between the hatch lid and hatch base.
Figure 4:
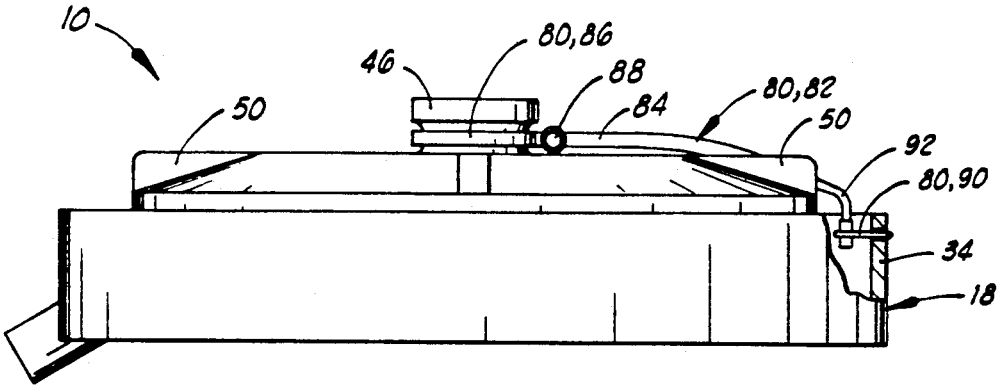
FIG. 4 is a front elevation view of the apparatus of FIG. 3.

As seen in FIGS. 3 and 4, a releasable latching means 80 is included for preventing rotation of hatch lid 20 relative to hatch base 18 after the lid thread 44 is tightly engaged with the base thread 38.

The releasable latching means 80 includes a retainer strap 82 having an inner end 84 connected to the handle 46 by a collar 86. Collar 86 is loosely disposed about the reduced diameter neck of handle 46 and is connected to strap 82 with a bolt 88. The releasable latching means 80 also includes a clip 90 which connects an outer end 92 of strap 82 to container base 18. All of the components of latching means 80 are preferably constructed of non-metallic materials.

The strap 82 is an elastomeric strap. As best seen in FIG. 3. a mid portion of the strap 82 is snugly stretched about one of the hammer lugs 50 to prevent rotation of the hatch lid 20 relative to the hatch base 18. Strap 82 also functions as a tether when the lid 20 is removed from base 18.

The releasable latch means 80 allows the hatch lid 20 to be easily assembled with the hatch base 18, but then serves to latch the same together after they have been tightly connected. The loose arrangement of collar 86 about the reduced diameter neck of handle 46 allows for easy assembly of the lid 20 on the base 18. So long as the retainer strap 82 is stretched out of the way of the lugs 50, the lid 20 can be rotated within the collar 86 so as to easily thread the lid 20 onto the base 18.

The clip 90 is positioned on base 18 so that when lid 20 is tightly threaded onto base 18, the strap 82 can be stretched about the closest lug 50 as seen in FIG. 3. The retaining means 80 thus serves as an anti-vibration retainer so that the threaded engagement of lid 20 with base 18 cannot become loose due to vibration as the vehicle carrying container 12 moves along the highway.

Thus it is seen that the apparatus of the present invention readily achieves the ends and advantages mentioned as well as those inherent therein. While certain preferred embodiments of the invention have been illustrated and described for purposes of the present disclosure, numerous changes in the arrangement and construction of parts may be made by those skilled in the art, which changes are encompassed within the scope and spirit of the present invention as defined by the appended claims.

What is claimed is:

1. A hatch apparatus for a container having a container opening defined therein with a container flange surrounding said container opening, comprising:

a non-metallic hatch base including a base flange complementary to and constructed to be bolted to said container flange, said hatch base having a hatch opening defined therethrough and including a male base thread defined on said hatch base and surrounding said hatch opening;

a non-metallic hatch lid having a female lid thread defined thereon, said female lid thread being complementary to said male base thread so that said hatch lid can be attached to said hatch base to close said hatch opening by threaded engagement of said female lid thread with said male base thread; and annular seal means disposed between said hatch base and said hatch lid and surrounding said hatch opening for sealing between said hatch base and said hatch lid around said hatch opening, said seal means being disposed inside of said female lid thread and said male base thread so that liquid in said container is prevented from reaching said threads.

2. A hatch apparatus for a container having a container opening defined therein with a container flange surrounding said container opening, comprising:

a non-metallic hatch base including a base flange complementary to and constructed to be bolted to said container flange, said hatch base having a hatch opening defined therethrough and including a base thread defined on said hatch base and surrounding said hatch opening, said hatch base further including an annular spillwell partially defined by said base flange; and a non-metallic hatch lid having a lid thread defined thereon, said lid thread being complementary to said base thread so that said hatch lid can be attached to said hatch base to close said hatch opening by threaded engagement of said lid thread with said base thread.

3. The apparatus of claim 2, wherein:

said hatch base further includes drain means for draining said spillwell.

4. A hatch apparatus for a container having a container opening defined therein with a container flange surrounding said container opening, comprising:

a non-metallic hatch base including a base flange complementary to and constructed to be bolted to said container flange, said hatch base having a hatch opening defined therethrough and including a base thread defined on said hatch base and surrounding said hatch opening;

a non-metallic hatch lid having a lid thread defined thereon, said lid thread being complementary to said base thread so that said hatch lid can be attached to said hatch base to close said hatch opening by threaded engagement of said lid thread with said base thread;

annular seal means disposed between said hatch base and said hatch lid and surrounding said hatch opening for sealing between said hatch base and said hatch lid around said hatch opening; and safety vent means for releasing pressure in said container as soon as said annular seal means is broken when said hatch lid is being threadedly removed from said hatch base.

5. The apparatus of claim 4, wherein:

said seal means is disposed inside of said lid thread and said base thread so that liquid in said container is prevented from reaching said threads.

6. The apparatus of claim 4, wherein:

said safety vent means includes a vent groove defined in one of said base thread and said lid thread, said vent groove being generally parallel to a central axis of said hatch opening.

7. A hatch apparatus for a container having a container opening defined therein with a container flange surrounding said container opening, comprising:

a non-metallic hatch base including a base flange complementary to and constructed to be bolted to said container flange, said hatch base having a hatch opening defined therethrough and including a base thread defined on said hatch base and surrounding said hatch opening;

a non-metallic hatch lid having a lid thread defined thereon, said lid thread being complementary to said base thread so that said hatch lid can be attached to said hatch base to close said hatch opening by threaded engagement of said lid thread with said base thread;

annular seal means disposed between said hatch base and said hatch lid and surrounding said hatch opening for sealing between said hatch base and said hatch lid around said hatch opening;

wherein said hatch base includes a cylindrical collar portion having said hatch opening defined therethrough and having an axially inner end and an axially outer end, said base flange extending radially outward from said axially inner end and said base thread being a male thread disposed on an exterior of said collar portion adjacent said axially outer end, said axially outer end having a tapered conical sealing surface defined thereon;

wherein said hatch lid has a conical lid surface defined thereon complementary to said conical sealing surface of said hatch base and has a groove defined in said conical lid surface, said groove facing said conical sealing surface; and wherein said seal means includes an O-ring seal disposed in said groove of said hatch lid and sealingly engaging said sealing surface of said hatch base.

8. The apparatus of claim 7, wherein:

said hatch base has at least one safety vent groove defined across said male base thread.

9. A hatch apparatus for a container having a container opening defined therein with a container flange surrounding said container opening, comprising:

a non-metallic hatch base including a base flange complementary to and constructed to be bolted to said container flange, said hatch base having a hatch opening defined therethrough and including a base thread defined on said hatch base and surrounding said hatch opening; and a non-metallic hatch lid having a lid thread defined thereon, said lid thread being complementary to said base thread so that said hatch lid can be attached to said hatch base to close said hatch opening by threaded engagement of said lid thread with said base thread, said hatch lid further including a handle integrally formed therewith and centrally located on an outer surface of said hatch lid.

10. The apparatus of claim 9, wherein:

said hatch lid further includes a plurality of hammer lugs integrally formed thereon.

11. A hatch apparatus for a container having a container opening defined therein with a container flange surrounding said container opening, comprising:

a non-metallic hatch base including a base flange complementary to and constructed to be bolted to said container flange, said hatch base having a hatch opening defined therethrough and including a base thread defined on said hatch base and surrounding said hatch opening;

a non-metallic hatch lid having a lid thread defined thereon, said lid thread being complementary to said base thread so that said hatch lid can be attached to said hatch base to close said hatch opening by threaded engagement of said lid thread with said base thread; and wherein said hatch lid is a hollow lid defining an interior lid chamber therein, said lid including a vent communicating said chamber with the atmosphere and a threaded port means for communicating said chamber with an interior of said container.

12. The apparatus of claim 11, further comprising:

pressure relief means, disposed in said threaded port means, for relieving a pressure differential between said container and the atmosphere.

13. The apparatus of claim 11, wherein:

said hatch lid includes an outward extending handle integrally formed therewith, said chamber extending outward into said handle, and said vent is defined through said handle in a direction generally radial from a longitudinal axis of said hatch opening.

14. The apparatus for a container having a container opening defined therein with a container flange surrounding said container opening, comprising:

a non-metallic hatch base including a base flange complementary to and constructed to be bolted to said container flange, said hatch base having a hatch opening defined therethrough and including a base thread defined on said hatch base and surrounding said hatch opening;

a non-metallic hatch lid having a lid thread defined thereon, said lid thread being complementary to said base thread so that said hatch lid can be attached to said hatch base to close said hatch opening by threaded engagement of said lid thread with said base thread; and releasable latching means for preventing rotation of said hatch lid relative to said hatch base after said lid thread is tightly engaged with said base thread.

15. The apparatus of claim 14, wherein:

said hatch lid includes a centrally located handle on an outer surface thereof, and includes a plurality of hammer lugs located on said outer surface around a periphery of said hatch lid; and said releasable latching means includes an elastomeric retainer strap having an inner end connected to said handle and an outer end connected to said hatch base, with a middle portion of said retainer strap stretched about one of said hammer lugs to prevent rotation of said hatch lid relative to said hatch base.

16. The apparatus of claim 15, wherein:

said inner end of said retainer strap is loosely connected to said handle.

17. A hatch apparatus for a container having a container opening defined therein with a container flange surrounding said container opening, comprising:

a non-metallic hatch base including a base flange complementary to and constructed to be bolted to said container flange, said hatch base having a hatch opening defined therethrough and including a base thread defined on said hatch base and surrounding said hatch opening;

a non-metallic hatch lid having a lid thread defined thereon, said lid thread being complementary to said base thread so that said hatch lid can be attached to said hatch base to close said hatch opening by threaded engagement of said lid thread with said base thread; and wherein said hatch lid further includes:

an axially outer wall and an axially inner wall defining a cavity therebetween; and support means, disposed in said cavity and extending between said axially outer wall and said axially inner wall, for structurally interconnecting and rigidifying said axially outer wall and said axially inner wall.

18. The apparatus of claim 17, wherein:

said support means includes a plurality of support pillars integrally molded with said axially outer wall and said axially inner wall.

19. The apparatus of claim 17, wherein:

said support means includes a rigid polymeric foam substantially completely filling said cavity.

20. A hatch apparatus, comprising:

a non-metallic hatch base, including:

a cylindrical collar portion having a hatch opening defined therethrough and having an axially inner end and an axially outer end;

a base flange integrally formed with said collar portion and extending radially outward from said inner end of said collar portion, said base flange having a pattern of bolt holes defined therein;

an annular upward extending lip integrally formed on a radially outer portion of said base flange so that said lip, said base flange, and said collar portion define an upwardly open annular spillwell surrounding said collar portion; and an external male base thread defined on said collar portion adjacent said axially outer end thereof;

a non-metallic hatch lid, including:

a disc-shaped cover portion;

an annular skirt integrally formed with and extending downward from said cover portion and having a female lid thread defined therein, so that said lid thread can be threadedly engaged with said base thread to close said hatch opening;

a handle integrally formed on an upper surface of said cover portion; and a plurality of hammer lugs integrally formed with said cover portion; and annular seal means, disposed between said hatch base and said hatch lid for sealing between said hatch base and said hatch lid around said hatch opening.

21. The apparatus of claim 20, wherein:

said hatch base further includes drain means for draining said spillwell.

22. The apparatus of claim 20, further comprising:

releasable latching means for preventing rotation of said hatch lid relative to said hatch base after said lid thread is tightly engaged with said base thread.

23. The apparatus of claim 22, wherein:

said releasable latching means includes an elastomeric retainer strap having an inner end connected to said handle and an outer end connected to said lip of said hatch base, with a middle portion of said retainer strap stretched about one of said hammer lugs to prevent rotation of said hatch lid relative to said hatch base.

24. The apparatus of claim 20, wherein:

said cover portion of said hatch lid is hollow defining an interior lid chamber therein.

25. The apparatus of claim 24, wherein:

said hatch lid has a vent defined therein communicating said chamber with the atmosphere;

said hatch lid has a threaded port defined therein communicating said chamber with a lower surface of said cover portion; and said apparatus further includes a pressure relief means, disposed in said threaded port for relieving a pressure differential across said hatch lid.

26. The apparatus of claim 20, wherein:

said cover portion of said hatch lid includes an axially outer wall and an axially inner wall defining a cavity therebetween; and said apparatus further includes support means, disposed in said cavity and extending between said axially inner wall and said axially outer wall, for rigidifying said axially outer wall and said axially inner wall.

27. The apparatus of claim 26, wherein:

said support means includes a plurality of support pillars integrally molded with said axially inner wall and said axially outer wall.

28. The apparatus of claim 26, wherein:

said support means includes a rigid polymeric foam substantially completely filling said cavity.

29. The apparatus of claim 20, wherein:

said hatch base has at least one safety vent groove defined across said male base thread.

* * * * *